US008252121B2

(12) United States Patent
Brunswick et al.

(10) Patent No.: US 8,252,121 B2
(45) Date of Patent: Aug. 28, 2012

(54) DRAIN SYSTEM FOR A WAREWASHER

(75) Inventors: Brian A. Brunswick, Tipp City, OH (US); David Fischer, Fairborn, OH (US); Thomas A. Grueser, Donnelsville, OH (US); Steven H. Kramer, Osgood, OH (US); Michael T. Watson, Beavercreek, OH (US)

(73) Assignee: Premark FEG L.L.C., Wilmington, DE (US)

( * ) Notice: Subject to any disclaimer, the term of this patent is extended or adjusted under 35 U.S.C. 154(b) by 527 days.

(21) Appl. No.: 12/514,820

(22) PCT Filed: Nov. 28, 2007

(86) PCT No.: PCT/US2007/085711

§ 371 (c)(1),
(2), (4) Date: May 14, 2009

(87) PCT Pub. No.: WO2008/067352

PCT Pub. Date: Jun. 5, 2008

(65) Prior Publication Data

US 2010/0059086 A1 Mar. 11, 2010

Related U.S. Application Data

(60) Provisional application No. 60/872,031, filed on Nov. 30, 2006.

(51) Int. Cl.
*B08B 3/02* (2006.01)

(52) U.S. Cl. ..... 134/25.2; 134/111; 134/186

(58) Field of Classification Search ..... 134/186, 134/104.2, 111, 25.2

See application file for complete search history.

(56) References Cited

U.S. PATENT DOCUMENTS 203,745 A 5/1878 Leverty (Continued)

FOREIGN PATENT DOCUMENTS

EP 0333251 9/1989

(Continued)

OTHER PUBLICATIONS

International Search Report and Written Opinion, PCT/US2007/085711 (Jun. 16, 2008).

(Continued)

*Primary Examiner* — Frankie L Stinson

(74) *Attorney, Agent, or Firm* — Thompson Hine LLP

(57) ABSTRACT

A warewasher for washing wares includes a chamber for receiving wares. The chamber has an associated liquid delivery system for spraying liquid onto wares within the chamber. A tank collects the sprayed liquid. A liquid recirculation system moves liquid from the tank back to the liquid delivery system. A drain system is located within the tank. The drain system includes a well, a liquid recirculation system inlet within the well and a drain opening within the well. A drain control assembly includes a drain stopper member and a strainer connected with the drain stopper member. When the drain stopper member is positioned to block flow through the drain opening, the strainer is positioned to block passage of tableware into the well. The strainer is mounted for sliding movement along a length of the drain stopper member enabling, when the drain stopper member is raised slightly to permit flow out of the drain opening, the strainer to remain in position to block passage of tableware into the well.

18 Claims, 15 Drawing Sheets

U.S. PATENT DOCUMENTS

| | | | | | |
|---|---|---|---|---|---|
| 1,327,708 | A | * | 1/1920 | Guy | 222/189.06 |
| 1,511,825 | A | | 10/1924 | Burns | |
| 1,717,229 | A | * | 6/1929 | Kraeft | 134/97.1 |
| 2,075,443 | A | * | 3/1937 | Kirschner et al. | 4/287 |
| 2,142,924 | A | | 1/1939 | Stoddard | |
| 2,241,940 | A | * | 5/1941 | Atkins et al. | 261/124 |
| 2,263,963 | A | * | 11/1941 | Barry | 68/208 |
| 2,279,619 | A | * | 4/1942 | Fisher | 134/58 R |
| 2,403,526 | A | | 7/1946 | Harris | |
| 2,418,366 | A | | 4/1947 | Powers | |
| 2,573,794 | A | * | 11/1951 | Kueneman | 134/138 |
| 2,649,765 | A | * | 8/1953 | Anderson | 134/104.1 |
| 2,669,240 | A | | 2/1954 | Thorson | |
| 2,681,658 | A | | 6/1954 | Meeker et al. | |
| 2,689,576 | A | | 9/1954 | Colstad | |
| 2,722,225 | A | | 11/1955 | Carson | |
| 2,842,161 | A | | 7/1958 | Hunter et al. | |
| 2,907,335 | A | | 10/1959 | Abresch | |
| 3,025,864 | A | | 3/1962 | Ensign | |
| 3,174,489 | A | | 3/1965 | Jellies et al. | |
| 3,217,884 | A | | 11/1965 | Long | |
| 3,319,651 | A | | 5/1967 | Ullman, Jr. et al. | |
| 3,464,437 | A | | 9/1969 | Zane | |
| 3,903,909 | A | * | 9/1975 | Noren et al. | 134/58 D |
| 4,086,938 | A | * | 5/1978 | Churley | 137/586 |
| 4,657,188 | A | | 4/1987 | Crane et al. | |
| 5,236,137 | A | | 8/1993 | Coogan | |
| 5,272,775 | A | * | 12/1993 | Walraven | 4/652 |
| 5,676,319 | A | | 10/1997 | Stiggins et al. | |
| 5,937,879 | A | | 8/1999 | Payzant | |
| 6,058,526 | A | | 5/2000 | Parisi et al. | |
| 6,276,000 | B1 | * | 8/2001 | Saman et al. | 4/287 |
| 2004/0073992 | A1 | * | 4/2004 | Saman et al. | 4/287 |

FOREIGN PATENT DOCUMENTS

| | | | |
|---|---|---|---|
| JP | 06-205734 | * | 7/1994 |
| JP | 11-164803 | * | 6/1999 |
| JP | 2006-296937 | * | 11/2006 |
| KR | 2005104919 | * | 11/2005 |
| WO | 2004/096005 | | 11/2004 |

OTHER PUBLICATIONS

European Search Report, European Application No. 08159139.8 (Oct. 23, 2008).

International Preliminary Report on Patentability, PCT/US2007/085711 (Jun. 11, 2009).

* cited by examiner

DRAIN SYSTEM FOR A WAREWASHER

CROSS-REFERENCE TO RELATED APPLICATIONS

This application claims priority to U.S. Provisional Application No. 60/872,031, filed Nov. 30, 2006.

TECHNICAL FIELD

This application relates generally to pass through type warewasher systems which are used in commercial applications such as cafeterias and restaurants and, more particularly, to such a warewash system including a drain system having combined drain and pump intake.

BACKGROUND

Commercial warewashers commonly include a housing area which defines washing and rinsing zones for dishes, pots pans and other wares. In certain zones, water is typically pumped from a tank through a pump intake, delivered to the wares via a spraying operation and collected in the tank for re-use. Occasionally, the water is drained from the tank through a drain for a cleaning operation. The drain may be separate from the pump intake.

SUMMARY

In an aspect, a warewasher for washing wares includes a chamber for receiving wares. The chamber has an associated liquid delivery system for spraying liquid onto wares within the chamber. A tank collects the sprayed liquid. A liquid recirculation system moves liquid from the tank back to the liquid delivery system. A drain system is located within the tank. The drain system includes a well, a liquid recirculation system inlet within the well and a drain opening within the well. A drain control assembly includes a drain stopper member and a strainer connected with the drain stopper member. When the drain stopper member is positioned to block flow through the drain opening, the strainer is positioned to block passage of tableware into the well. The strainer is mounted for sliding movement along a length of the drain stopper member enabling, when the drain stopper member is raised slightly to permit flow out of the drain opening, the strainer to remain in position to block passage of tableware into the well.

In another aspect, a method of operating a warewasher is provided. The method includes delivering a liquid to a chamber of the warewasher using a liquid delivery system. The liquid is received in a tank located below the chamber. Draining of the liquid in the tank through a drain opening of a drain system is prevented using a plug portion of a drain control assembly located within a drain body of the drain system. Liquid is filtered through a strainer of the drain control assembly as the liquid enters the drain body. The strainer is moveable relative to the drain control assembly while being connected thereto. The liquid is recirculated using a liquid recirculation system including a liquid recirculation inlet in communication with the drain body. The liquid recirculation system delivers liquid to the liquid delivery system.

In another aspect, a warewasher for washing wares includes a chamber, a liquid delivery system configured to deliver liquid to the chamber and a tank at the bottom of the chamber for collecting liquid. A liquid recirculation system is configured to move liquid from the tank to the liquid delivery system. A drain system includes a drain body that receives liquid from the tank, a recirculation system inlet through which liquid can be drawn from the drain body and a drain opening through which liquid can be drained from the drain body. A drain control assembly includes a support member and a strainer slidingly supported by the support member such that the strainer moves relative to the support member. The drain control assembly is configured to be located at the drain system such that the strainer strains liquid flowing into the drain body.

The details of one or more embodiments are set forth in the accompanying drawings and the description below. Other features, objects, and advantages will be apparent from the description and drawings, and from the claims.

DETAILED DESCRIPTION

Figure 1:
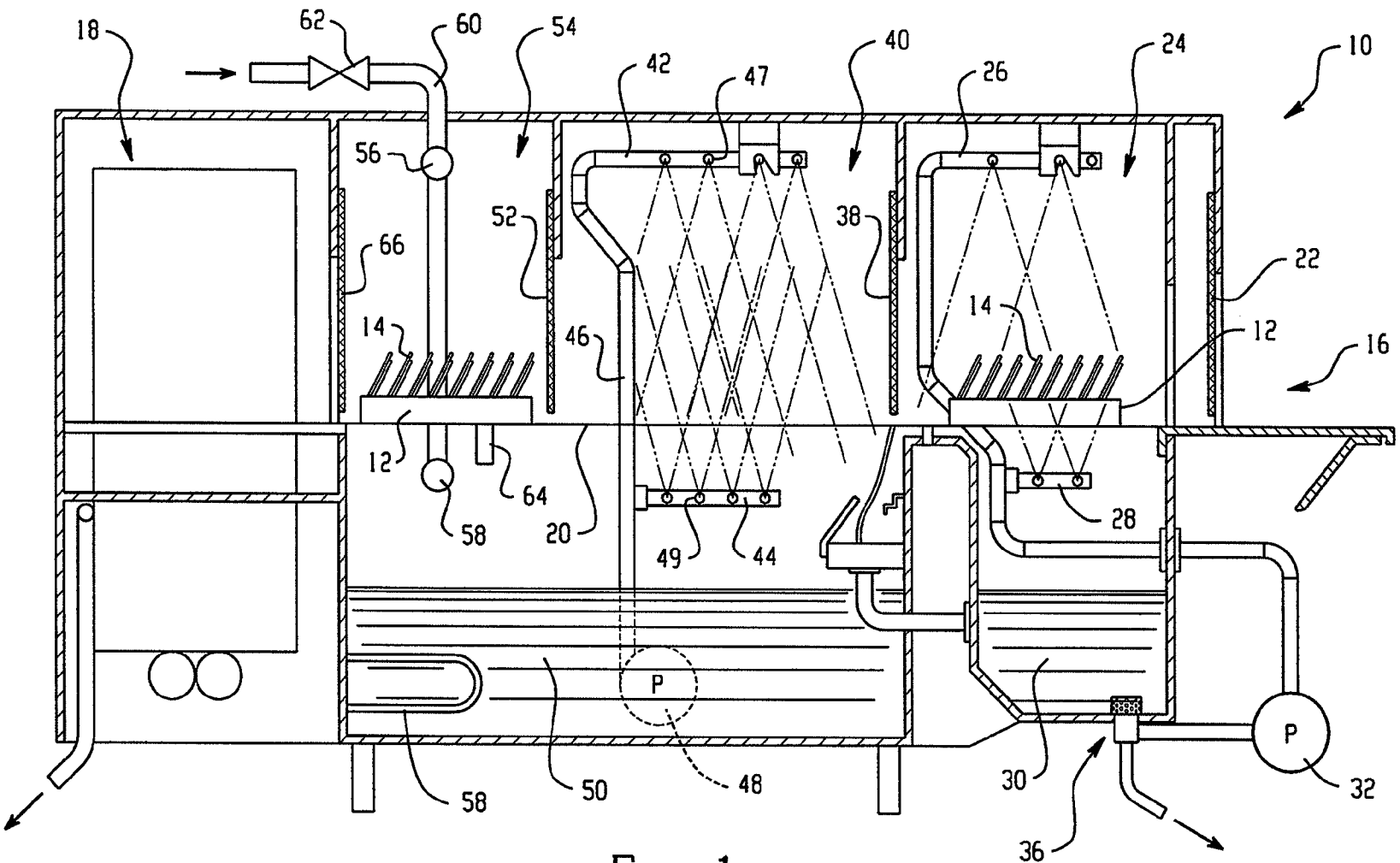
FIG. 1 is a diagrammatic side, section view of an embodiment of a warewash system.

Referring to FIG. 1, an exemplary conveyor-type warewash system, generally designated 10, is shown. Warewash system 10 can receive racks 12 of soiled wares 14 from an input side 16 which are moved through tunnel-like chambers from the input side toward a dryer unit 18 at an opposite end of the warewash system by a suitable conveyor mechanism 20. Either continuously or intermittently moving conveyor mechanisms or combinations thereof may be used, depending, for example, on the style, model and size of the warewash system 10. The racks 12 of soiled wares 14 enter the warewash system 10 through a flexible curtain 22 into a pre-wash chamber or zone 24 where sprays of liquid from upper and lower pre-wash manifolds 26 and 28 above and below the racks, respectively, function to flush heavier soil from the wares. The liquid for this purpose comes from a tank 30 via a pump 32 and supply conduit 34. As will be described below, a drain system 36 provides a single location where liquid is pumped from the tank 30 using the pump 32 and where liquid can be drained from the tank, for example, for a tank cleaning operation.

The racks proceed to a next curtain 38 into a main wash chamber or zone 40, where the wares are subject to sprays of cleansing liquid from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse chamber or zone (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 58 that are supplied with a flow of fresh hot water via pipe 60 under the control of solenoid valve 62. A rack detector 64 is actuated when rack 12 of wares 14 is positioned in the final rinse chamber 54 and through suitable electrical controls, the detector causes actuation of the solenoid valve 62 to open and admit the hot rinse water to the spray heads 56, 58. The water then drains from the wares into tank 50. The rinsed rack 12 of wares 14 then exit the final rinse chamber 54 through curtain 66, moving into dryer unit 18.

Figure 2:
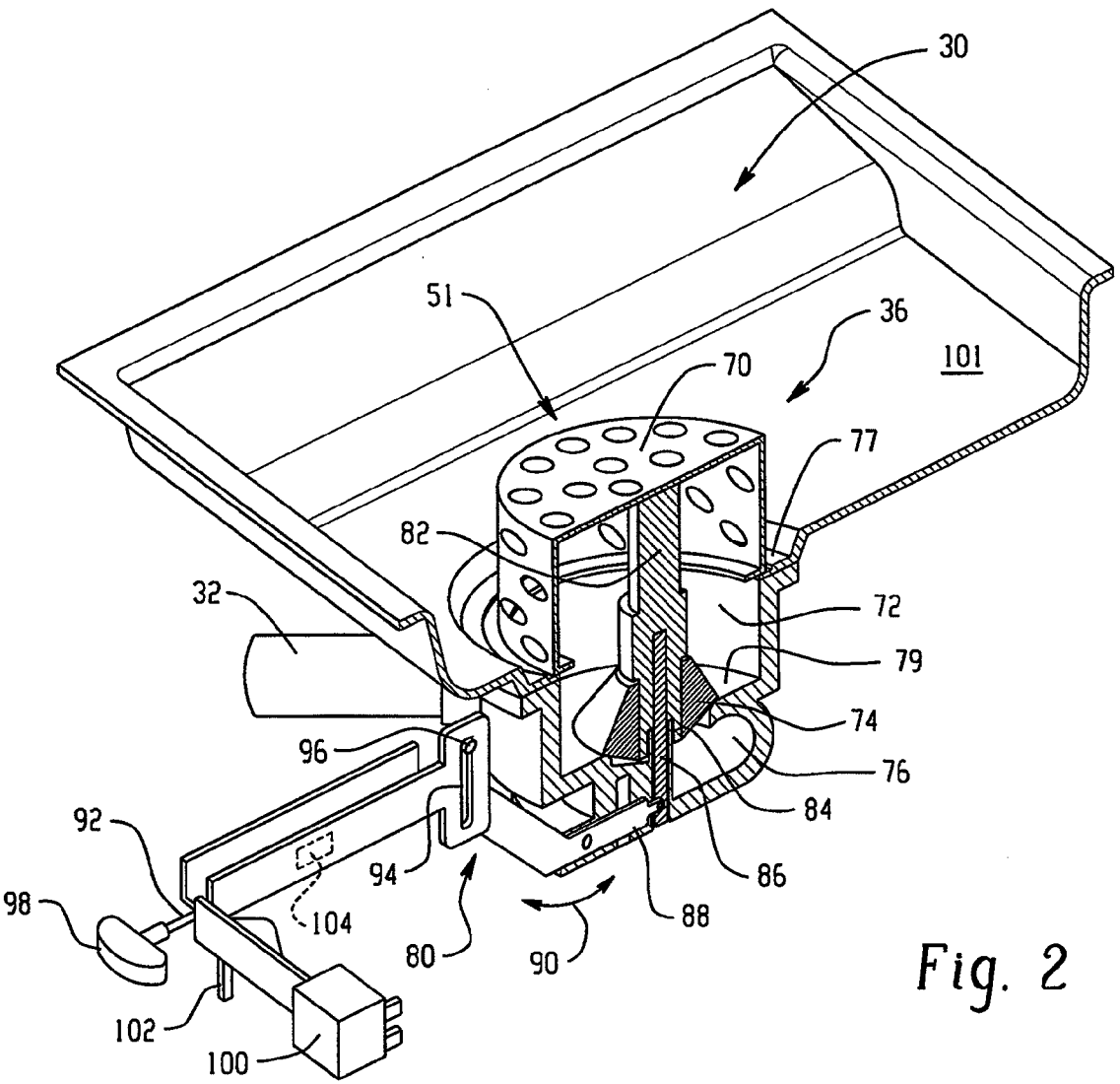
FIGS. 2 and 3 are side, section views of an embodiment of a drain system in a closed configuration for use with the warewash system of FIG. 1.
Figure 3:
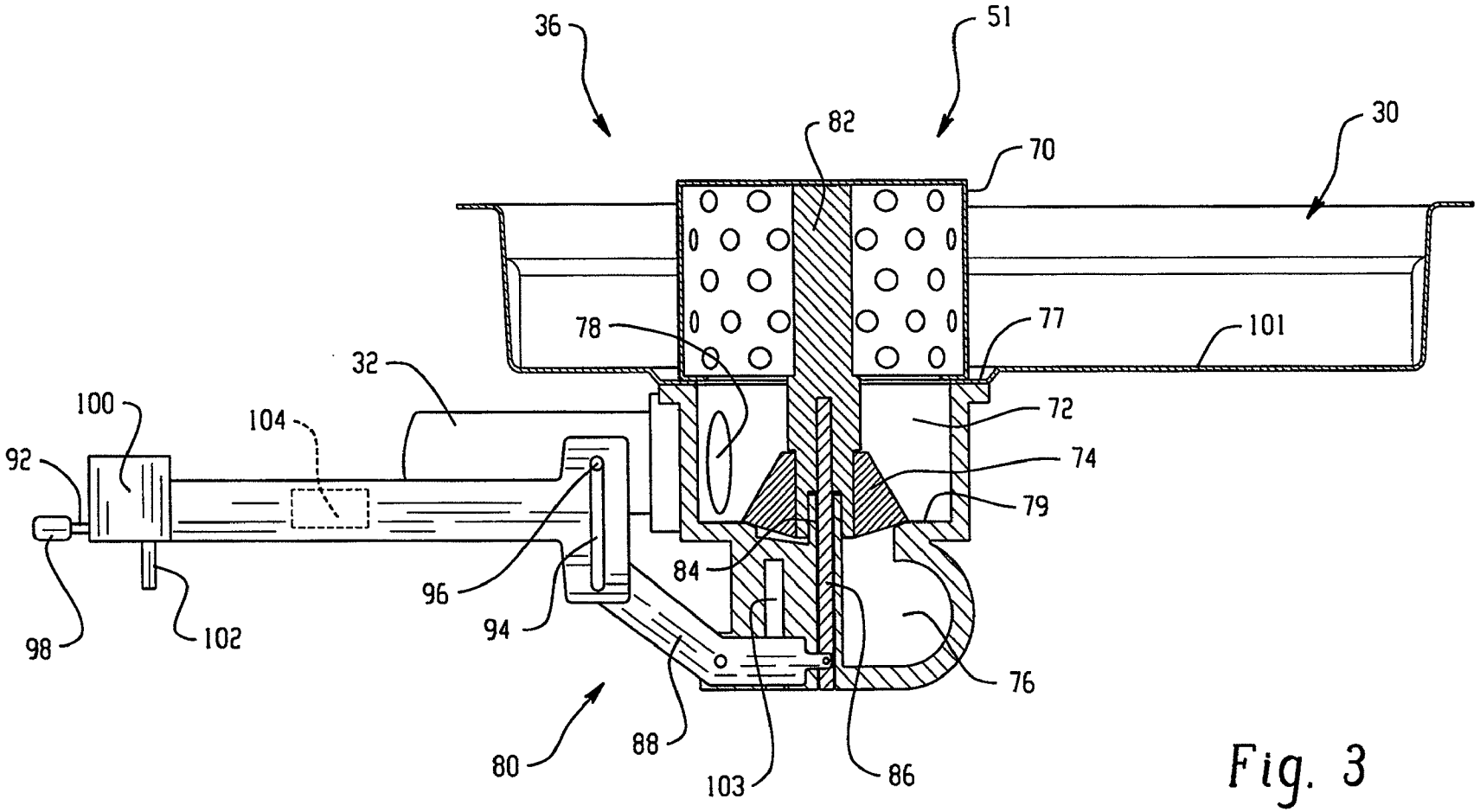

Referring now to FIGS. 2 and 3, drain system 36 is shown in a closed configuration where liquid is prevented from draining from the tank 30, for example, to maintain liquid level within the tank. A drain control assembly 51 includes a cylindrical pump strainer 70 (e.g., formed of stainless steel or other suitable material such as plastic) that overlies a drain body or well 72 and a plug portion or stopper 74 that, in the illustrated closed configuration, prevents liquid from flowing from the well through a drain port 76. A pump intake 78 (in the illustrated case, an opening in the well sidewall) is in communication with the well 72 for allowing the pump 32 to draw strained liquid from the well during use. With the drain system 36 in the closed position, pump strainer 70 is seated against an upper tank surface 77 about the periphery of the well 72, to limit ingress of large items that could be pulled into the pump intake, and the stopper 74 is seated against a bottom surface 79 of the well 72, forming a seal that prevents liquid from exiting the well through the drain port 76.

Figure 4:
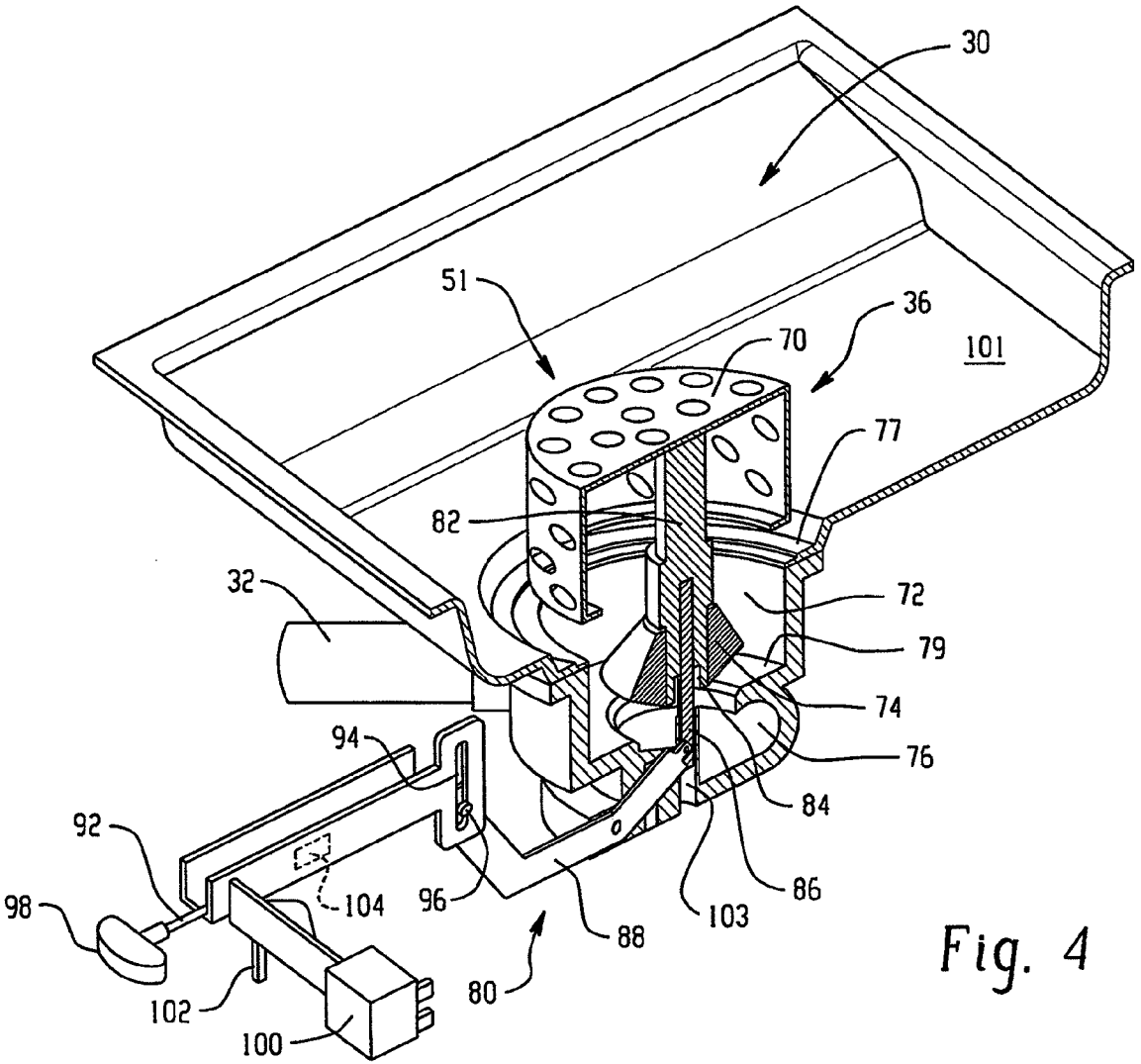
FIGS. 4 and 5 are side, section views of the drain system of FIGS. 2 and 3 in an open configuration.
Figure 5:
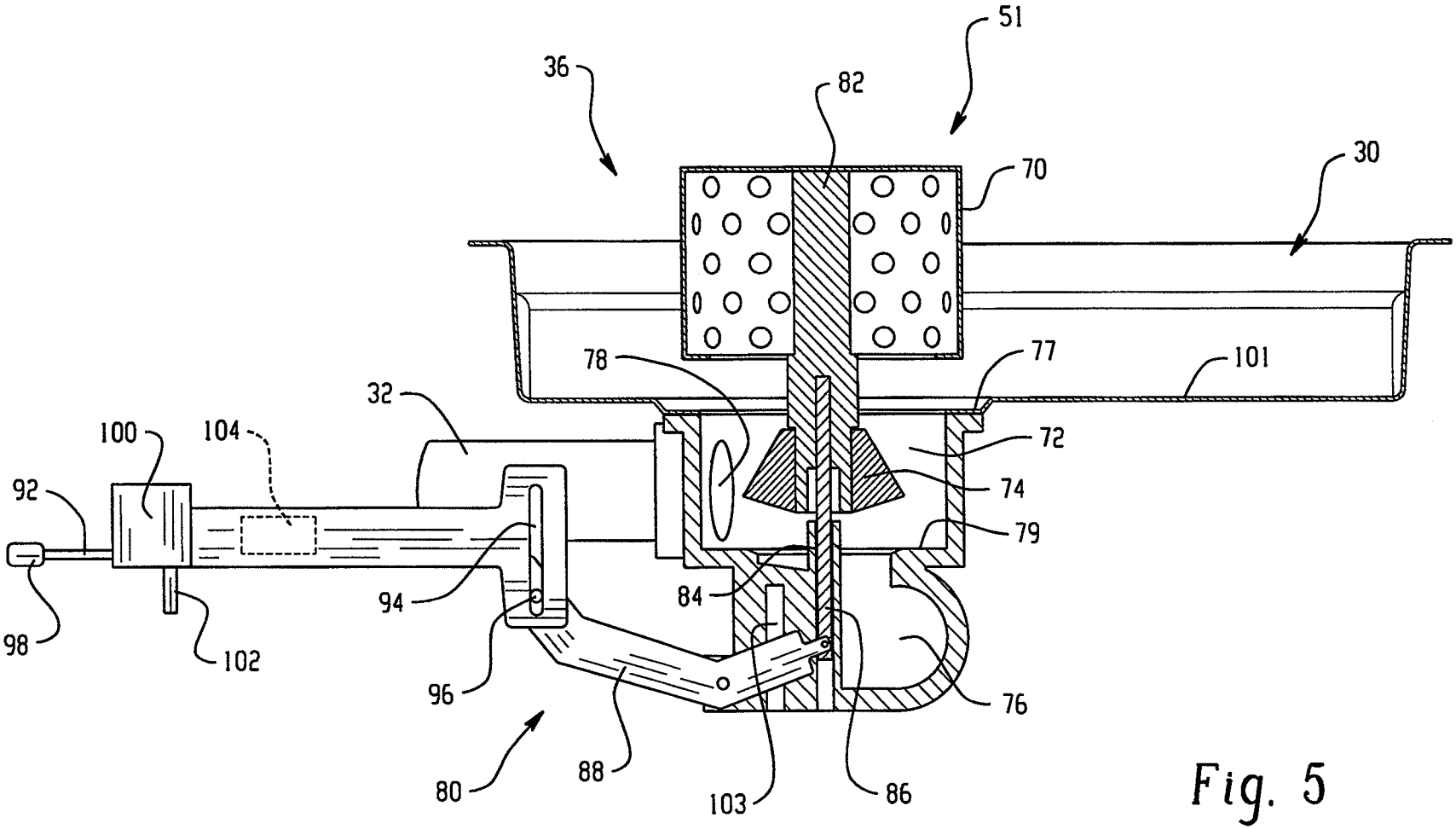

A lever system 80 is provided so that the drain control assembly 51 can be moved from the closed configuration to an open configuration illustrated by FIGS. 4 and 5. The pump strainer 70 and stopper 74 are connected to each other by an outer stalk 82. Outer stalk 82 includes a bore 84 that receives an inner stalk 86, which is connected to a lever arm 88. Lever arm 88 can be pivoted in the direction of arrow 90 from the position illustrated in FIGS. 2 and 3 to the position illustrated in FIGS. 4 and 5 using pull bar 92. At one end, pull bar 92 includes a slot 94 that receives a projection 96 that is sized to slide within the slot. At an opposite end, pull bar 92 includes a handle 98 that is graspable by a user to allow the user to pull the pull bar away from the drain which causes the stopper 74 and pump strainer 70 to raise (e.g., about one inch). With the drain system 36 in the open position, liquid including sediment and food particles can flow beneath the pump strainer 70, into the well 72 and out the drain port 76. Typically, the pump 32 is turned off so that particles will not flow into the pump with the drain system 36 in the open configuration. In some embodiments, bottom 101 is slanted downwardly toward the drain system 36 to facilitate movement of particles toward the drain system with the drain system in the open configuration.

A solenoid 100 is used to maintain the pull bar 92 in the open configuration. The pull bar 92 is spring biased toward the closed configuration. To place the drain system 36 in the closed configuration, a trigger 102 is actuated which actuates the solenoid 100 and allows the pull bar 92 to move under the force of a spring to the closed position illustrated by FIGS. 2 and 3. While the spring is not shown in FIGS. 2-5, it could be located in chamber 103 (see spring element 105 of FIGS. 11 and 12). In some embodiments, a position sensor 104 (e.g., an electronic eye) is used to monitor the position of the pull bar 92. Sensor 104 may be connected to a controller that determines when the drain system 36 is opened. The controller may be capable of controlling pump 32, for example, so that when the drain system 36 is in the open configuration, the pump is automatically turned off. As another example, the controller may provide an indication to the user that the drain system 36 is in the open configuration. Pull bar 92 and handle 98 provide easy access to the user to open and close the drain from a location outside the tank 30. In some embodiments, the pump strainer and stopper can be removed from the inner stalk 86, for example, to remove them from the tank 30.

Figure 6:
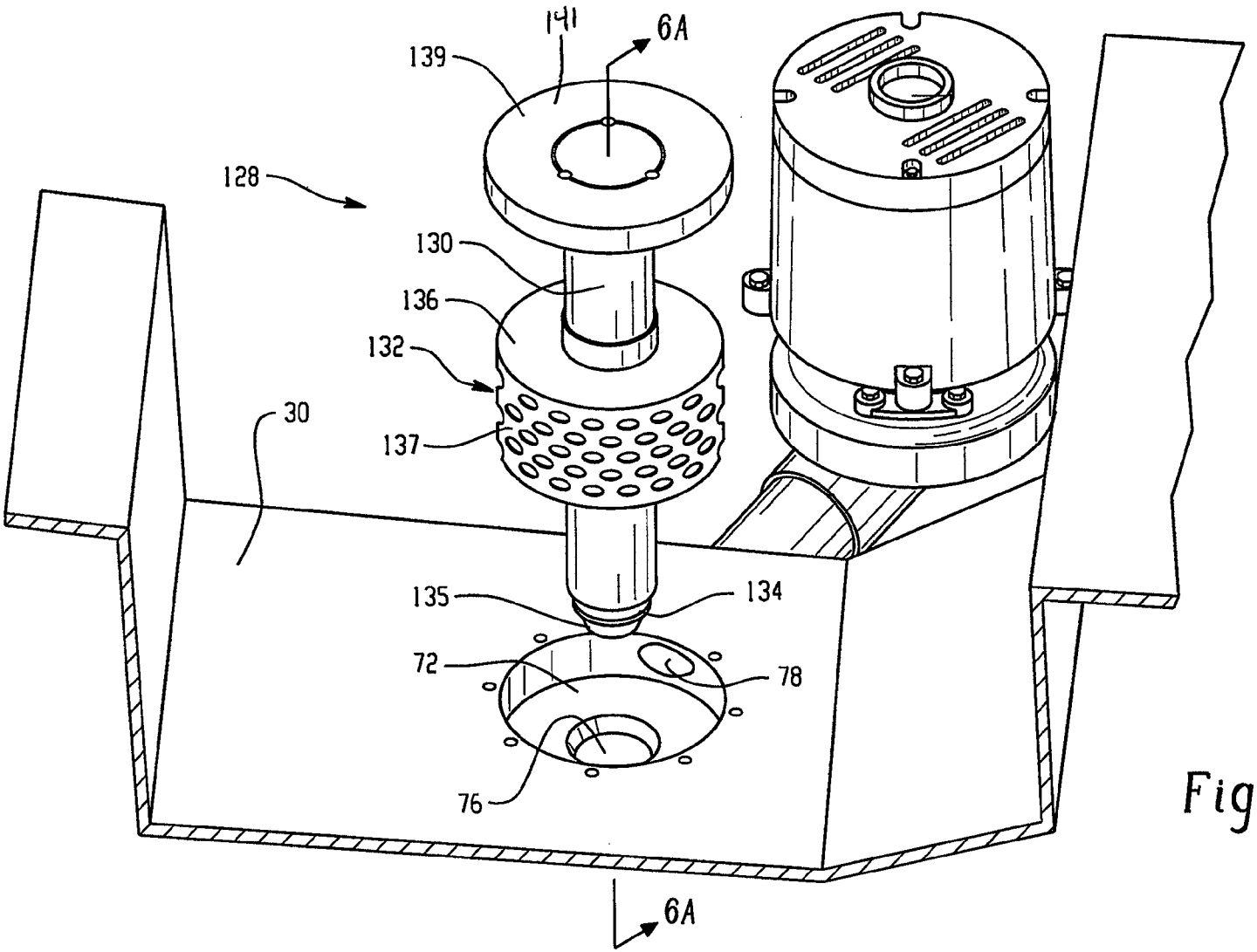
FIGS. 6-10 are various views of another embodiment of a drain system.

FIGS. 6-10 illustrate an alternative drain system embodiment 120 for use with the tank 30 including pump inlet 78 and drain port 76 that are both in communication with well 72. A drain control assembly 128 is used to control draining of liquid from the tank 30. The drain control assembly 128 includes a support member (e.g., in the form of a standpipe 130) that supports a strainer 132 thereon. FIG. 6 illustrates the drain control assembly 128 removed from the well 72. A drain plug portion 134 is located at an end of the standpipe 130, which can be positioned within the drain port 76 to prevent liquid from passing thereby. The drain plug portion 134 includes a tapered end 135 that is used to guide the drain plug portion into the drain port 76.

Figure 6A:
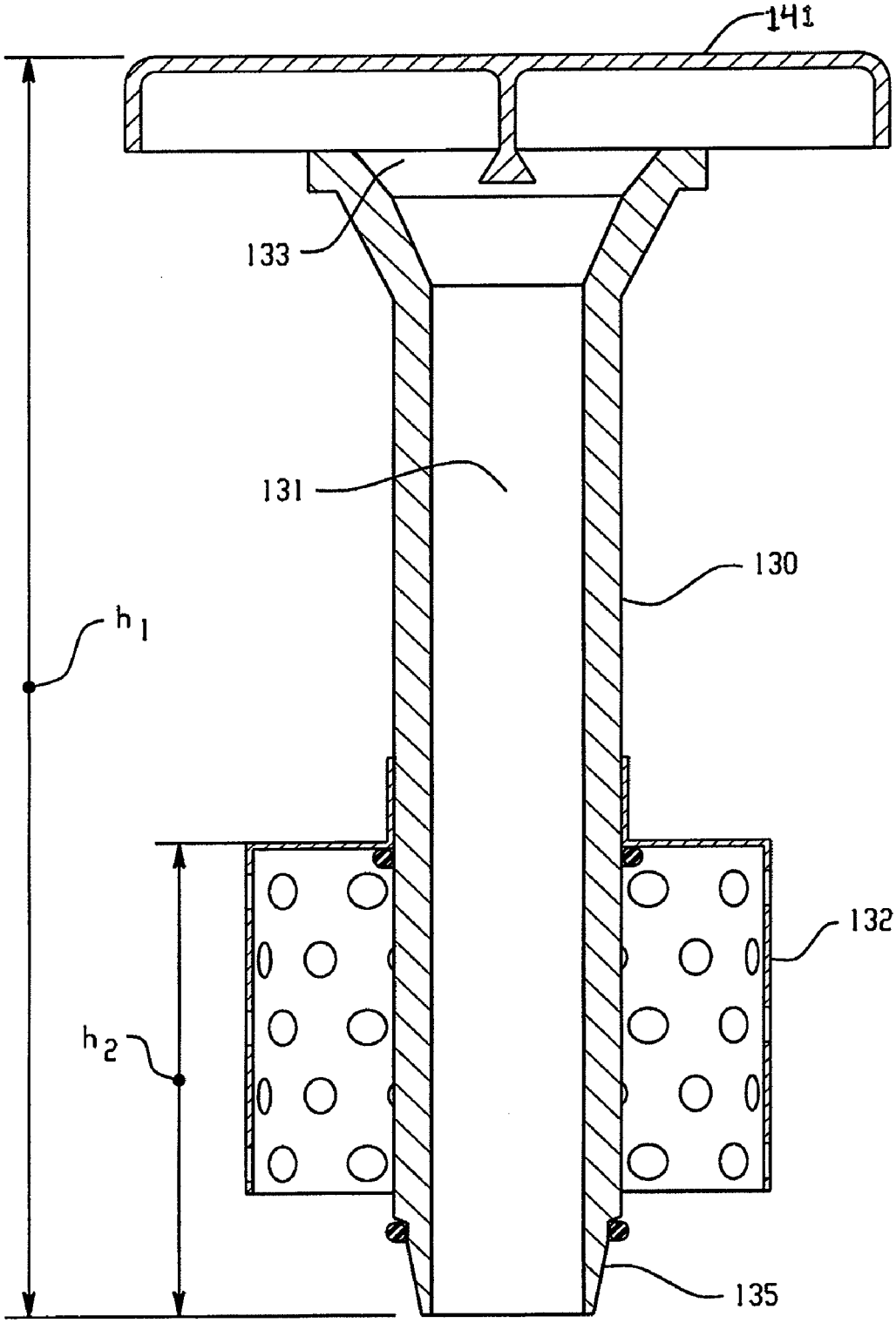

Referring briefly to FIG. 6A, the standpipe 130 includes an opening 131 extending from an upper end 133 of the standpipe through the tapered end 135. A deflector 141 may be included that is connected at the upper end 133 to the standpipe 130. The deflector 141 is spaced from the upper end 133 to allow liquid to pass therebetween during an overflow condition. The deflector 141 prevents large food particles and tableware (or other objects) from entering the opening 131.

Referring back to FIG. 6, the strainer 132 includes a wall 137 that extends about the standpipe 130 (e.g., in a cylindrical manner). The wall 137 includes openings through which liquid can pass while preventing passage of particles (e.g., large food particles) or other items such as tableware (e.g., knives, spoons, forks, etc.) thereby. A solid upper wall 136 covers a top of the wall 137. The upper wall 136 includes an opening sized to slidingly receive the standpipe 130. Other strainer shapes and configurations are contemplated. The upper wall 136 may also include strainer openings.

Figure 7:
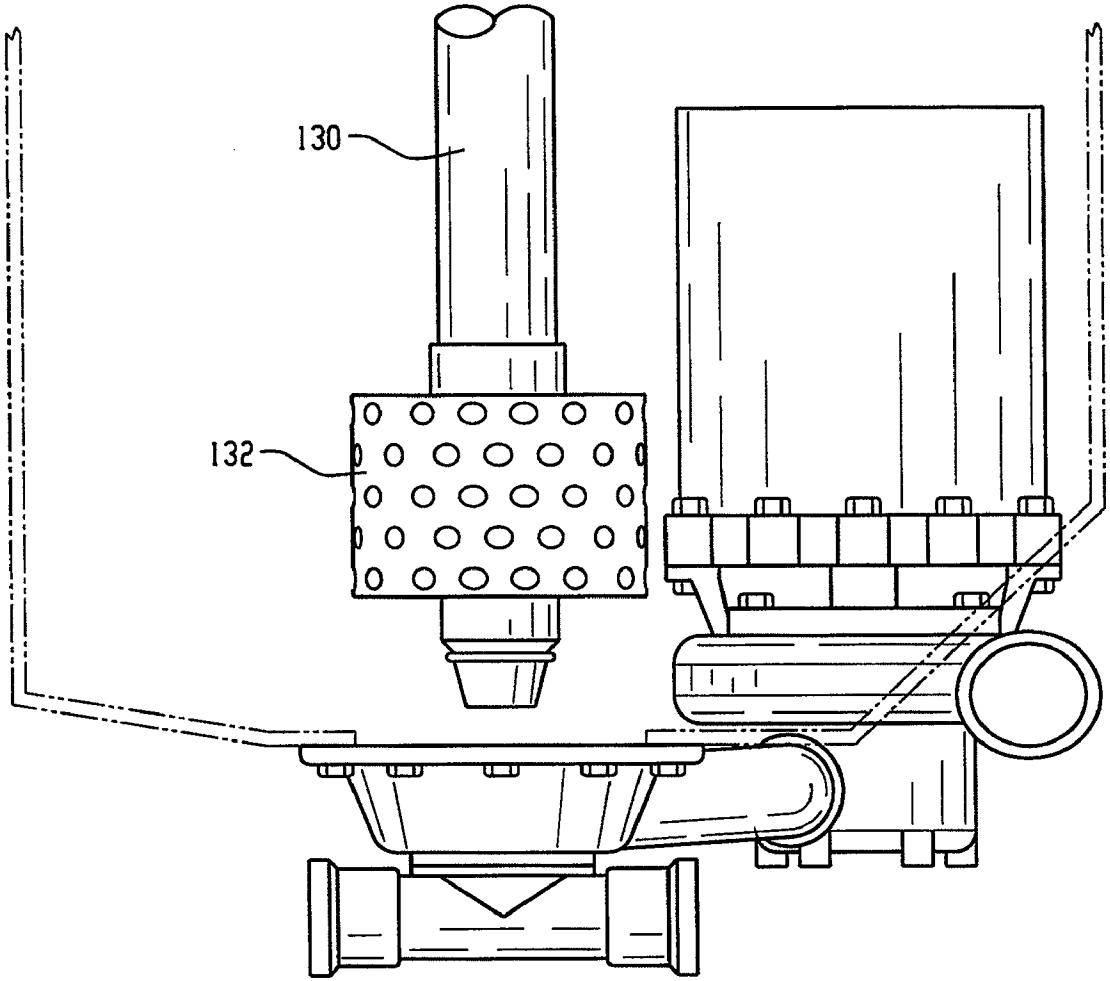
Figure 8:
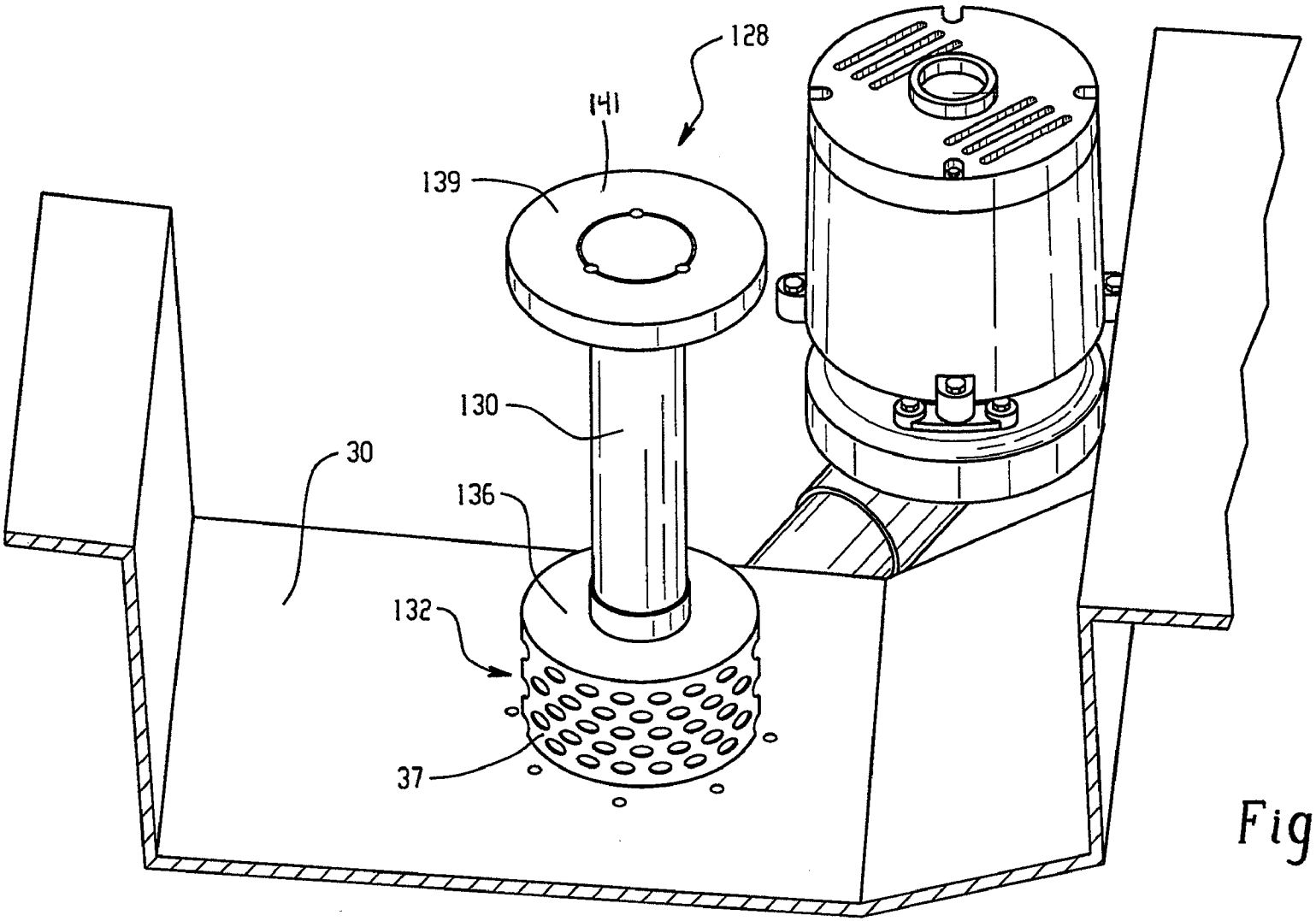

Referring now to FIG. 7, the strainer 132 and standpipe 130 are moveable relative to each other. FIG. 7 (and FIG. 6A) illustrates the strainer 132 in its fully lowered position, while FIG. 6 shows the strainer in its fully raised position relative to the standpipe 130. In some embodiments, the deflector 141 is at a height $h_1$ relative to the bottom end of the standpipe 130 that is greater than about two times (e.g., about three times or more) a height $h_2$ of the top of the strainer 132 from the bottom end of the standpipe 130 with the strainer at its fully lowered position (see FIG. 6A). Referring to FIG. 8, as the drain control assembly 128 is lowered into the well 72, the strainer 132 rests on the bottom surface of the tank 30. The combination of the tank surface and strainer 132 prevents passage of potentially obstructing items into the well 72.

Figure 9:
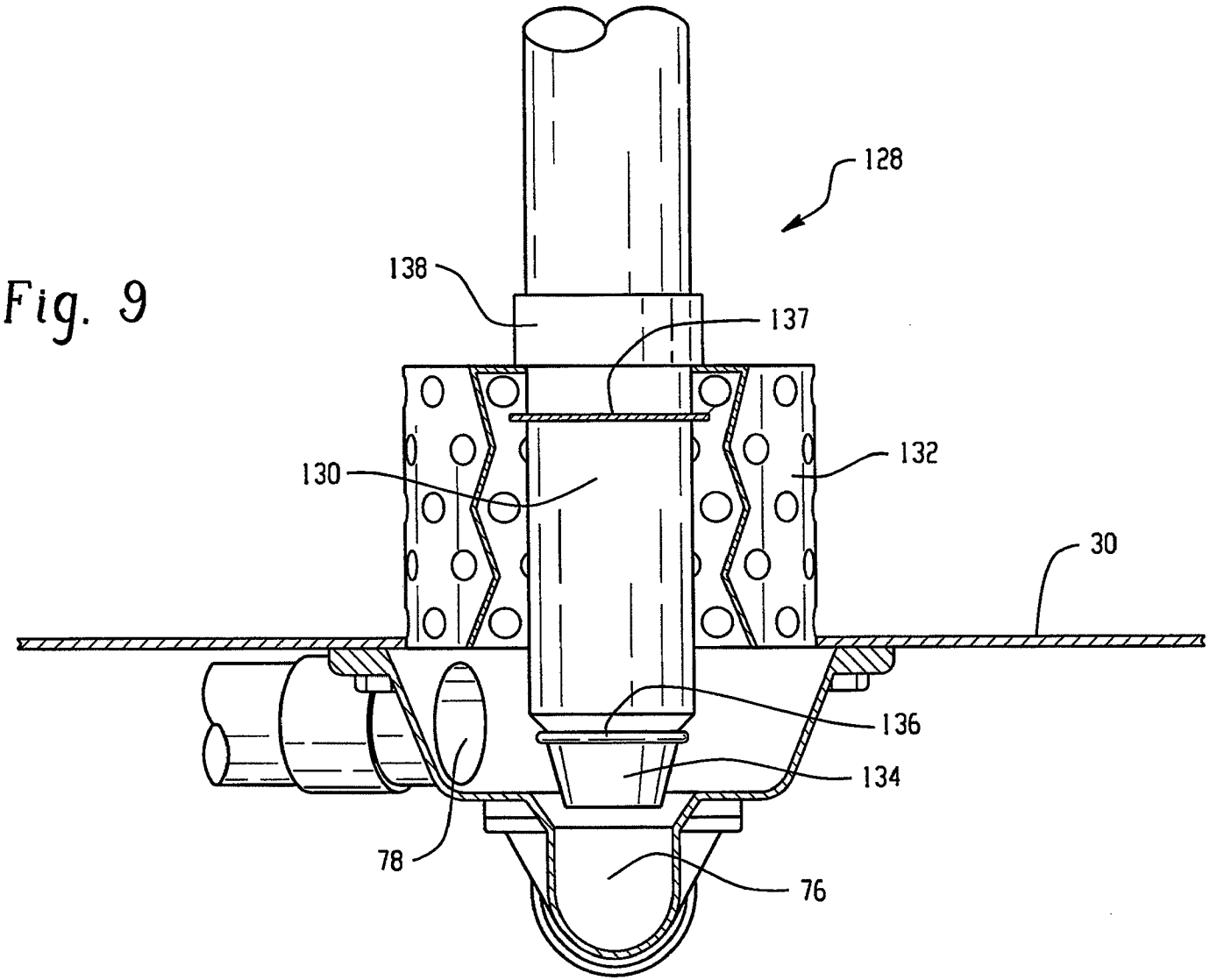

FIG. 9 illustrates the drain control assembly 128 in a configuration to allow strained liquid to drain through the drain port 76. In this configuration, the drain plug portion 134 of the standpipe 130 is lifted away from the drain port 76. The standpipe 130 may be lifted mechanically into this position and/or manually. As can be seen, in this position, the strainer 132 remains seated against the bottom of the tank 30. Thus, a user can effect tank draining by lifting the standpipe 130 slightly, without lifting the strainer 132 from its blocking position.

Figure 10:
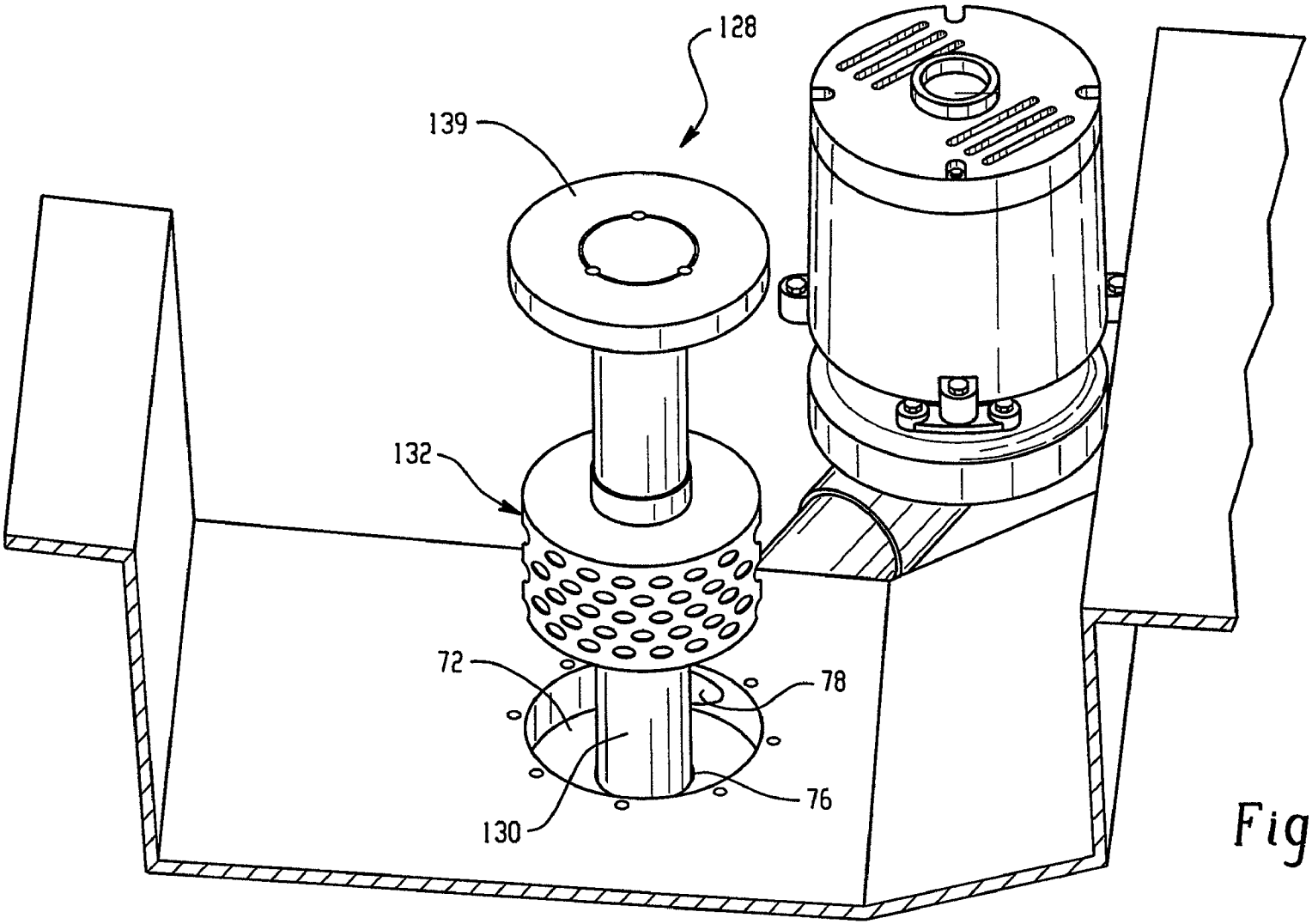

To prevent draining of liquid through the drain port 76, the standpipe 130 and drain plug portion 134 are lowered relative to the strainer 132. A seal member 136 (e.g., an O-ring) is provided on the drain plug portion 134 to provide a seal between the drain port 76 and the drain plug portion. With the drain plug portion 134 sealed with the drain port 76, filtered liquid can be drawn into the recirculation system from the well 72 and provided to the liquid delivery system while liquid is prevented from draining from the tank through the drain port. As can also be seen in FIG. 9, a stop 137 (e.g., a snap ring) is located on the standpipe 130 to prevent the strainer 132 from sliding thereby and off of the standpipe, for example, when the drain control assembly 128 is removed from the well 72 (e.g., for a cleaning operation). The stop 137 is located far enough down on the standpipe 130 to allow the standpipe to be removed from the drain port 76 while the strainer 132 remains seated against the bottom of the tank. The stop 137 may be removable to facilitate separation of the strainer 132 from the standpipe 130. There may be another stop located above the strainer 132 on the standpipe 130 to prevent the strainer from being raised off of the standpipe. In the head 139 of the standpipe there is an enlarged end that can act as a stop. FIG. 10 shows the strainer 132 in a raised position with the drain plug portion 134 located in the drain port 76.

Referring again to FIG. 9, in some embodiments, a tube member 138 is connected to the upper wall 136 of the strainer 132. The tube member 138 includes an opening through which the standpipe 130 extends. The tube member 138 interacts with the standpipe 130 to provide lateral stabilization of the strainer 132 on the standpipe. The opening of the tubular member 138 or may be free sliding.

The drain system embodiment of FIGS. 6-10 is an assembly that is arranged to be manually inserted and removed. However, such an assembly could be linked with a mechanical system (such as those described herein) for triggering tank drain operations.

Figure 11:
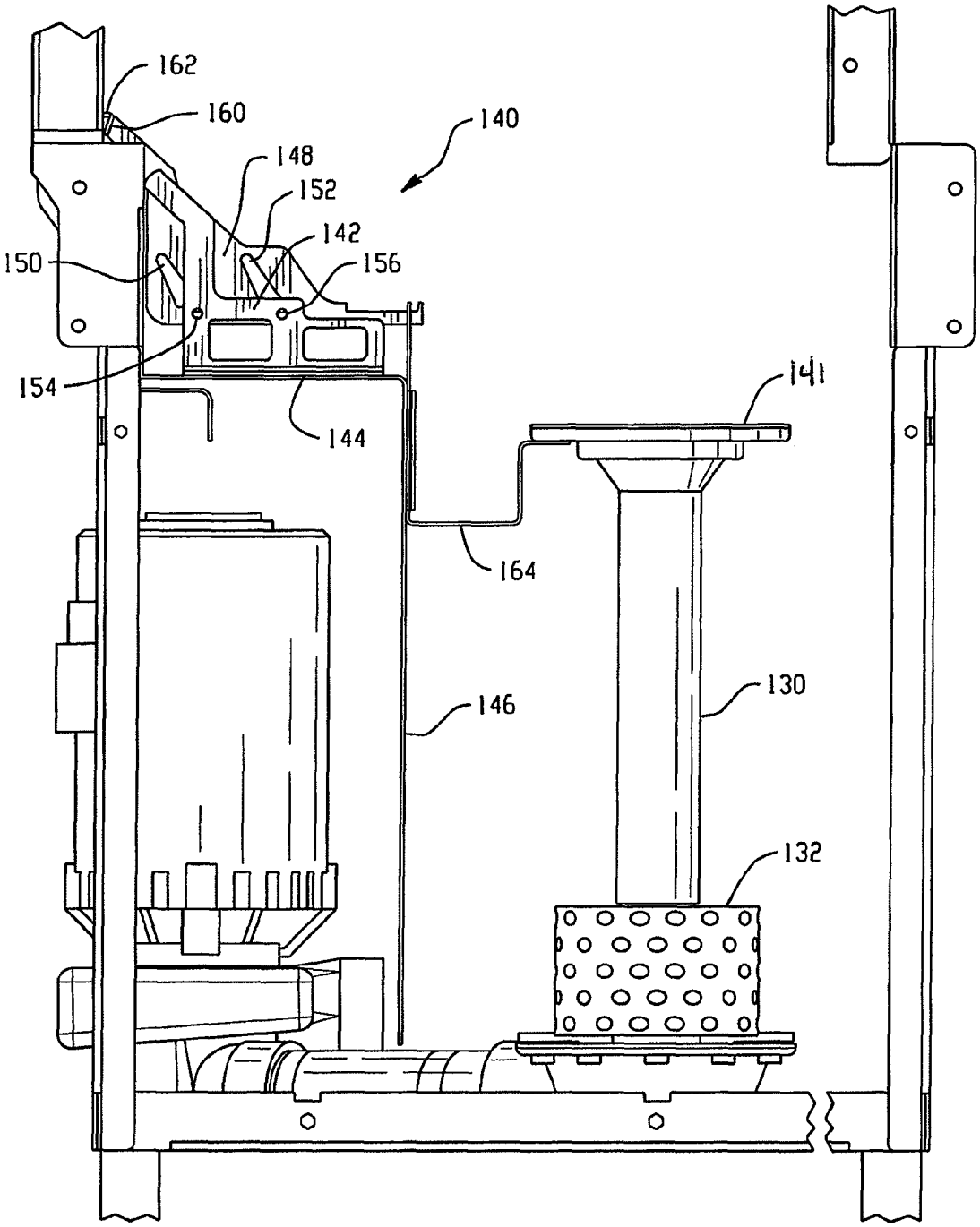
FIGS. 11 and 12 illustrate operation of a system for use in opening and closing the drain system.
Figure 12:
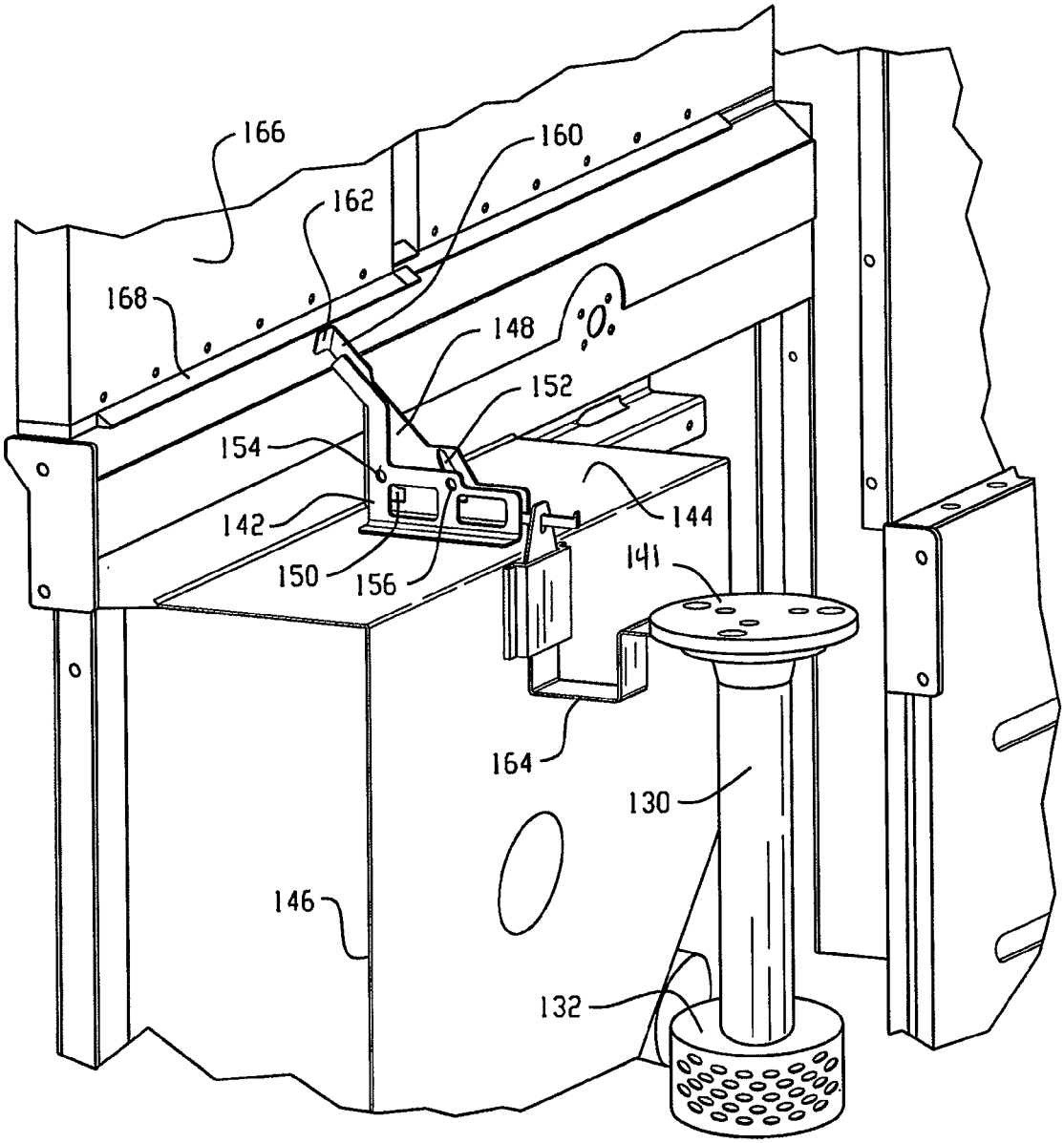

FIGS. 11 and 12 illustrate an example of a drain lift linkage 140 for use in lifting an lowering the standpipe 130. The drain lift linkage 140 includes a support bracket 142 that is mounted on an upper surface 144 of a pump housing 146. The support bracket 142 slidably supports a moveable member 148 that includes a pair of L-shaped slots 150 and 152 within which fasteners 154 and 156 are received. The moveable member 148 includes an engageable end 160 that includes a graspable portion 162 that can be grasped and pulled by an operator to lift the moveable member and pull the moveable member toward the operator. Due to the L-shape of the slots 150 and 152, the moveable member 148 can remain in the raised position until a horizontal force is applied thereto. The moveable member 148 is connected to a connector 164 that connects the standpipe 130 to the moveable member. In particular, the connector 164 is illustrated as being releasably engaged with the deflector 141, however, other configurations are possible.

FIG. 11 illustrates the standpipe 130 positioned in the raised position by the drain lift linkage 140. The slots 150 and 152 are sized such that moveable member 148 can be raised only so high (e.g., about ¾ inch) as to lift the standpipe 130 from the drain port 76 to allow liquid to pass therethrough while the strainer 132 remains seated against the bottom of the tank 30.

FIG. 12 illustrates the standpipe 130 in the lowered position, blocking the drain port 76. To place the standpipe 130 in the lowered position from the raised position, an operator can exert a horizontal force on the moveable member 148 thereby aligning the fasteners 154 and 156 with the vertical portions of the slots 150 and 152. The weight of the standpipe 130 causes the standpipe and the moveable member 148 to drop, thereby locating the standpipe within the drain port 76. In one embodiment, door 166 includes a ledge 168 that extends outwardly from the door. The ledge 168 is sized and positioned so as to contact the graspable portion 162 with the moveable member 148 in the raised position and the door 166 closed to apply the horizontal force to the moveable member to cause the standpipe to lower into its lowered position. This can prevent the standpipe 130 from being in the raised position if the door 166 is closed. The ledge 168 may also be sized so that is does not contact the graspable portion 162 with the moveable member 148 in its lowered position. The standpipe 130 and strainer 132 assembly can be removed from the drain port 76 for cleaning.

The above-described drain systems and drain control assemblies can provide a number of advantages. For example, by locating both the pump intake 78 and drain port 76 within a single well, cleaning of the warewasher 10 can be simplified. Additionally, locating the pump intake 78 at the drain port 76 places the pump intake below the bottom of the tank 30 thereby increasing the head above the intake. This increase in head above the pump intake 78 can improve performance of the pump 32.

Figure 13:
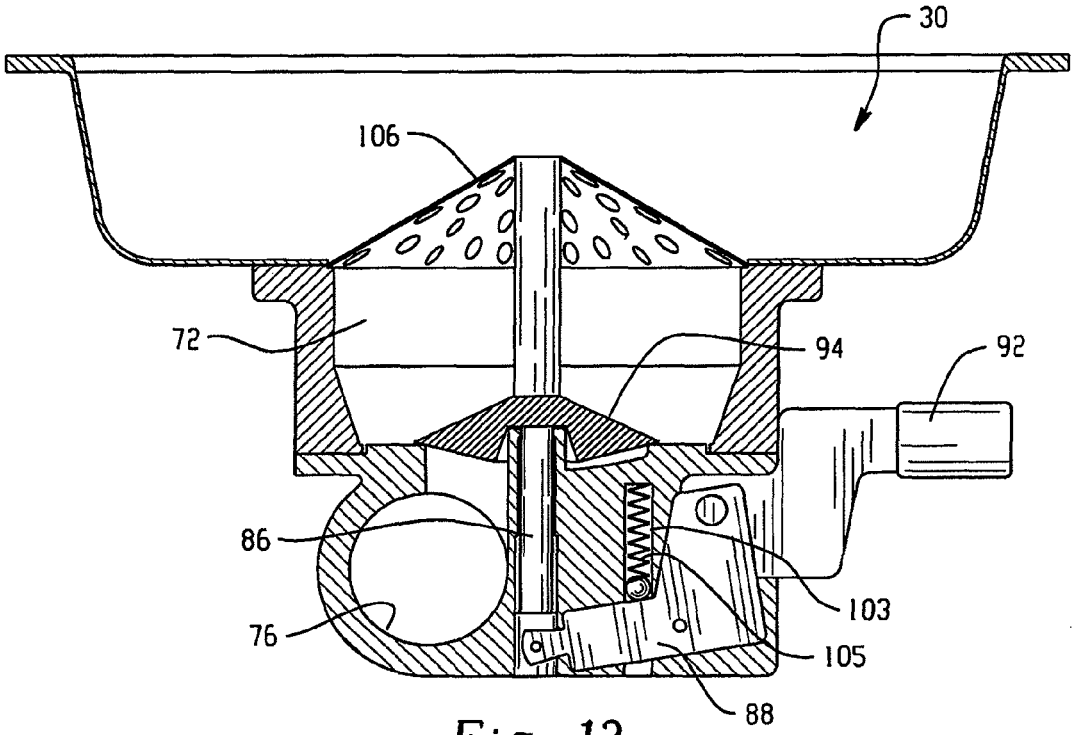
FIGS. 13 and 14 are side, section views of another embodiment of a drain system in closed and open configurations.
Figure 14:
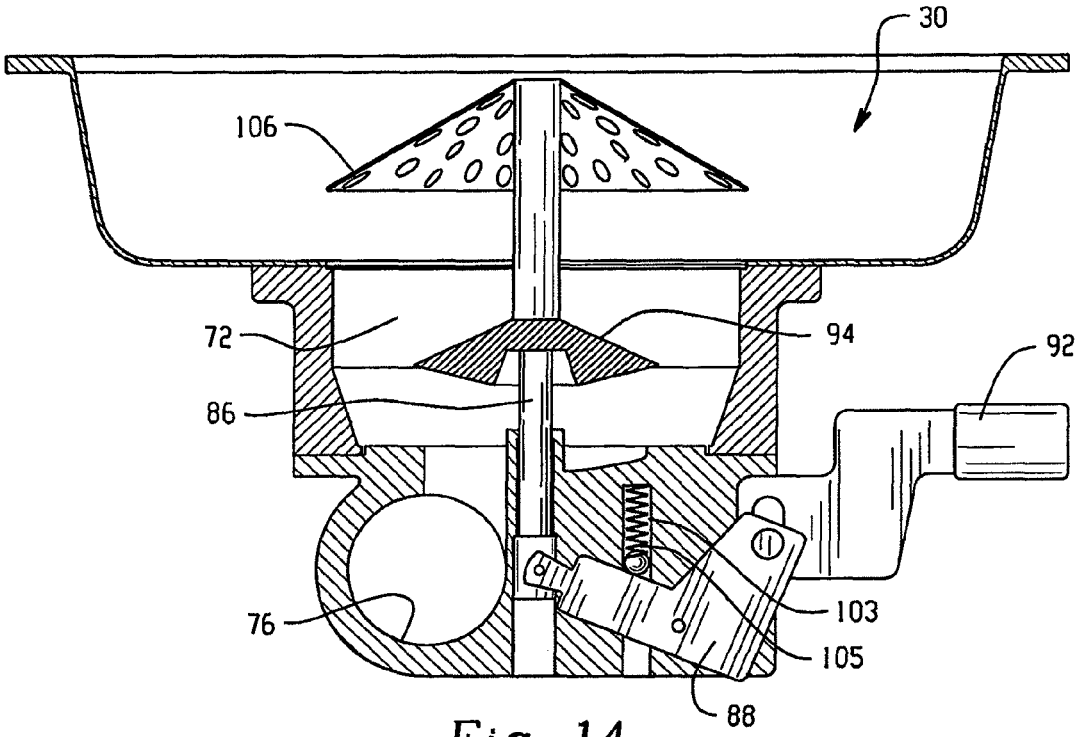
Figure 15:
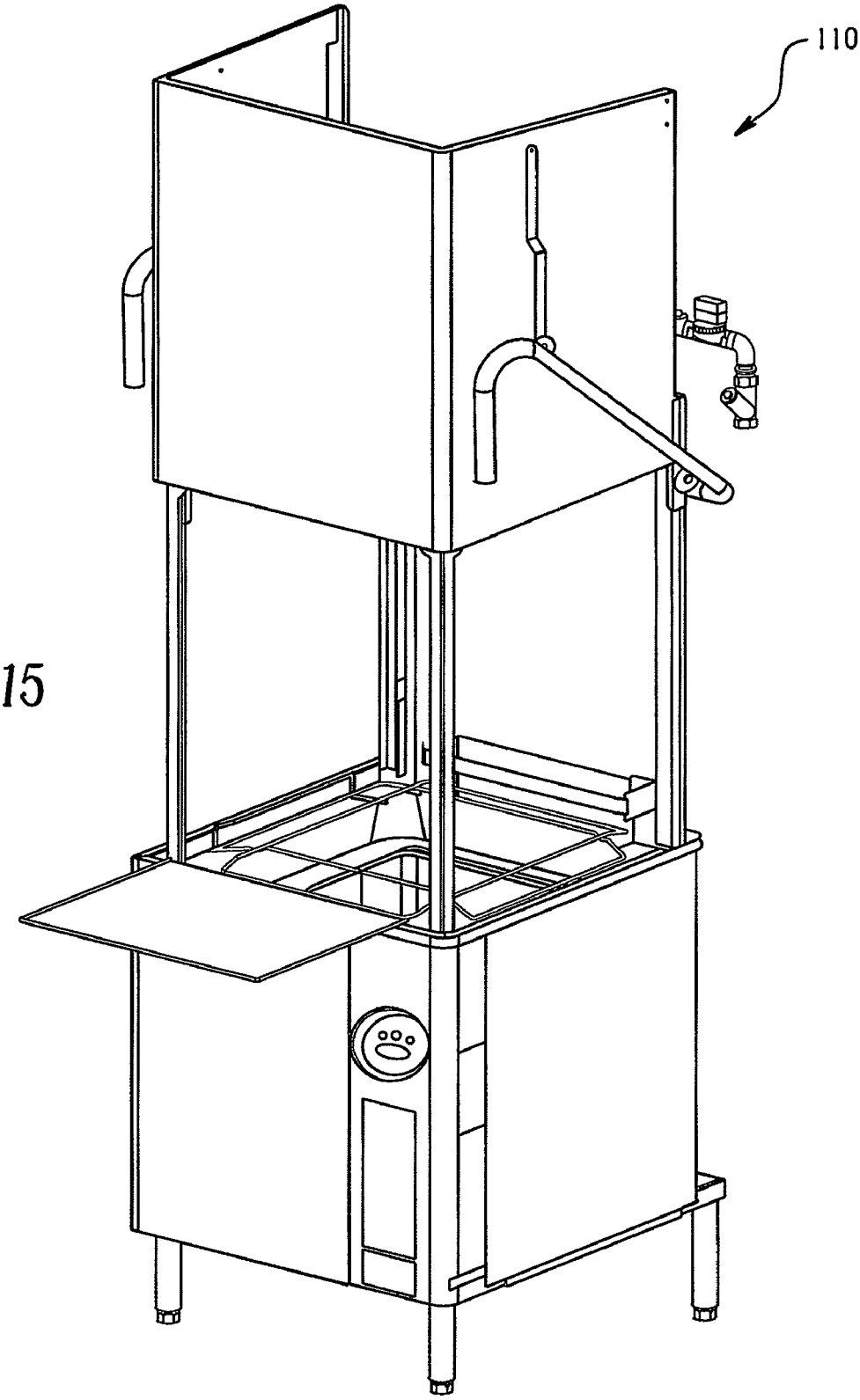
FIG. 15 is a perspective view of another embodiment of a warewasher.

It is to be clearly understood that the above description is intended by way of illustration and example only and is not intended to be taken by way of limitation, and that changes and modifications are possible. For example, a foot pedal may be used to open and close the drain system. FIGS. 13 and 14 show an alternative strainer 106 that is cone-shaped. Additionally, the drain systems (represented by the dotted lines) can be utilized in other non-conveyor type machines, such as warewasher 110 illustrated by FIG. 15 or an undercounter warewasher. Accordingly, other embodiments are contemplated and modifications and changes could be made without departing from the scope of this application.

What is claimed is:

1. A warewasher for washing wares, comprising:

a chamber for receiving wares, the chamber having an associated liquid delivery system for spraying liquid onto wares within the chamber;

a tank for collecting sprayed liquid;

a liquid recirculation system for moving liquid from the tank back to the liquid delivery system;

a drain system within the tank, the drain system including a well;

a liquid recirculation system inlet within the well;

a drain opening within the well; and a drain control assembly including a drain stopper member and a strainer connected with the drain stopper member, when the drain stopper member is positioned to block flow through the drain opening the strainer is positioned to both block passage of tableware into the well and to strain water that enters the well to travel to the liquid recirculation system inlet, the strainer including a top wall and a downwardly extending side wall;

wherein the strainer is mounted for sliding movement along a length of the drain stopper member enabling, when the drain stopper member is raised slightly to permit flow out of the drain opening, the strainer to remain in position to block passage of tableware into the well;

wherein a first stop is provided to prevent the strainer from sliding off of the bottom of the drain stopper member and a second stop is provided above the strainer to prevent the strainer from being raised off the drain stopper member.

2. The warewasher of claim 1, wherein the drain stopper member is formed by a standpipe that extends upward into the tank.

3. The warewasher of claim 2, wherein the standpipe includes an enlarged head portion that acts as the second stop.

4. The warewasher of claim 2, wherein the first stop is removable to facilitate separation of the strainer from the drain stopper member.

5. The warewasher of claim 1, wherein, when the drain stopper member is positioned to block passage of tableware into the well, a lower side of the strainer rests on a bottom portion of the tank circumscribing the well.

6. The warewasher of claim 1, wherein a lever system is associated with the drain stopper member for lowering and raising the drain stopper member.

7. The warewasher of claim 1, wherein the liquid recirculation system includes a pump that pulls liquid along a flow passage from the liquid recirculation system inlet and pumps the liquid along a flow passage to the liquid delivery system.

8. A method of operating a warewasher, the method comprising:

delivering a liquid to a chamber of the warewasher using a liquid delivery system;

receiving the liquid in a tank located below the chamber;

preventing draining of the liquid in the tank through a drain opening of a drain system using a plug portion of a drain control assembly located within a drain body of the drain system;

filtering liquid through a strainer of the drain control assembly as the liquid enters the drain body, the strainer including a top wall and a downwardly extending side wall sized to surround an inlet of the drain body when the plug portion is located to block flow through the drain opening, the strainer resting on a bottom of the tank and being moveable relative to the drain control assembly while being connected thereto and positioned to both block passage of tableware into the drain body and to strain water that enters the drain body to travel to a liquid recirculation system inlet; and recirculating the liquid using a liquid recirculation system including the liquid recirculation system inlet in communication with the drain body, the liquid recirculation system delivering liquid to the liquid delivery system, wherein the step of recirculating the liquid includes pumping the liquid using a pump of the liquid recirculation system from the drain body to the liquid delivery system.

9. A warewasher for washing wares, comprising:

a chamber;

a liquid delivery system configured to deliver liquid to the chamber;

a tank at the bottom of the chamber for collecting liquid;

a liquid recirculation system configured to move liquid from the tank to the liquid delivery system;

a drain system comprising a recessed drain body that receives liquid from the tank;

a recirculation system inlet through which liquid can be drawn from the recessed drain body; and a drain opening through which liquid can be drained from the recessed drain body; and a drain control assembly including a support member and a strainer slidingly supported by the support member such that the strainer moves relative to the support member, the drain control assembly configured to be located at the drain system such that the strainer strains liquid before the liquid flows into the recessed drain body.

10. The warewasher of claim 9, wherein the drain control assembly further comprises a plug portion at a lower end of the support member that is sized and configured to block passage of liquid through the drain opening with the plug portion inserted into the drain opening.

11. The warewasher of claim 10, wherein the support member is a standpipe that extends upward through an opening of the strainer.

12. The warewasher of claim 11, wherein the strainer includes a top wall and a downwardly extending side wall is sized to surround an inlet of the drain body when the plug portion is inserted into the drain opening.

13. The warewasher of claim 11, wherein the standpipe is moveable relative to the strainer such that the plug portion is removable from the drain opening to allow liquid to flow through the drain opening while the strainer remains resting against the bottom surface of the tank to strain liquid flowing into the drain body.

14. The warewasher of claim 13, wherein the strainer comprises at least one wall portion including openings that are sized to allow liquid to pass therethrough while preventing particles larger than the openings to pass therethrough.

15. The warewasher of claim 14, wherein the drain control assembly includes a lower stop carried by the standpipe, the stop preventing movement of the strainer along the standpipe past the stop.

16. The warewasher of claim 10, wherein the liquid recirculation system comprises a pump that pumps water from the drain body, through the recirculation system inlet and to the liquid delivery system, the support member is a standpipe that extends upward through an opening of the strainer, the standpipe is moveable relative to the strainer such that the plug portion is removable from the drain opening to allow liquid to flow through the drain opening while the strainer remains resting against the bottom surface of the tank to strain liquid flowing into the drain body, and an upper stop is carried by the standpipe for preventing the strainer from being raised off the standpipe.

17. The warewasher of claim 9 further comprising a drain lift linkage linked to the support member to raise and lower the support member while the strainer remains stationary.

18. The warewasher of claim 17 further comprising a door having an open configuration that allows user access to the chamber and a closed configuration that inhibits user access to the chamber, the drain lift linkage arranged and configured such that, in its closed configuration, the door engages the drain lift linkage with the drain lift linkage in a raised configuration to place the drain lift linkage in a lowered configuration.

* * * * *